US009409095B2

(12) United States Patent
Kropfl

(10) Patent No.: US 9,409,095 B2
(45) Date of Patent: Aug. 9, 2016

(54) VISUAL BACKGROUND SIMULATION

(71) Applicant: Keith Kropfl, Inc., San Clemente, CA (US)

(72) Inventor: Carrie Kropfl, San Clemente, CA (US)

(73) Assignee: STREETUBEZ, LLC, San Clemente, CA (US)

( * ) Notice: Subject to any disclaimer, the term of this patent is extended or adjusted under 35 U.S.C. 154(b) by 0 days.

(21) Appl. No.: 14/419,478

(22) PCT Filed: Jan. 27, 2014

(86) PCT No.: PCT/US2014/013228

§ 371 (c)(1),
(2) Date: Feb. 4, 2015

(87) PCT Pub. No.: WO2014/117100

PCT Pub. Date: Jul. 31, 2014

(65) Prior Publication Data

US 2015/0209681 A1 Jul. 30, 2015

Related U.S. Application Data

(60) Provisional application No. 61/756,765, filed on Jan. 25, 2013.

(51) Int. Cl.

| | |
|---|---|
| ***A63G 31/00*** | (2006.01) |
| ***A63J 5/02*** | (2006.01) |
| *G09B 5/00* | (2006.01) |

(52) U.S. Cl.
CPC . *A63G 31/00* (2013.01); *A63J 5/02* (2013.01); *Y10T 29/49826* (2015.01)

(58) Field of Classification Search
CPC ..... A63J 1/00; A63J 1/02; A63J 5/00; A63J 7/00; G09B 5/00; G09B 5/02; G09B 5/06; G06Q 99/00
USPC ..... 472/75–84; 434/366, 370, 433
See application file for complete search history.

(56) References Cited

U.S. PATENT DOCUMENTS

| | | | | |
|---|---|---|---|---|
| 747,045 A | | 12/1903 | Carter | |
| 1,205,444 A | | 11/1916 | Fuller | |
| 5,711,713 A | * | 1/1998 | Krueger | A63J 1/028 472/77 |
| 5,842,925 A | * | 12/1998 | Ellroy | A63J 5/02 40/407 |
| 8,696,522 B2 | | 4/2014 | Brady | |

OTHER PUBLICATIONS

PCT International Preliminary Report on Patentability Chapter 1 for PCT/US2014/013228, date of mailing Aug. 6, 2015, all pages.

* cited by examiner

*Primary Examiner* — Kien Nguyen
(74) *Attorney, Agent, or Firm* — Tope-McKay & Associates

(57) ABSTRACT

A visual background simulation allowing a user to create a wave simulation. The visual background simulation is composed of a sheet with at least three sides laid out flat on a surface and attached to the surface on one side. A player takes hold of the portion of the sheet opposite the side attached to the surface and lifting their arm high in the air runs towards and eventually past the attached side. This allows the sheet to billow and catch the air. Once past the attached side, the player may lower their arm and trap the air in a "tube" formed by the sheet and the surface.

15 Claims, 5 Drawing Sheets

VISUAL BACKGROUND SIMULATION

PRIORITY CLAIM

This is a non-provisional application of U.S. Provisional Application No. 61/756,765, filed in the United States on Jan. 25, 2013, and titled, "Street Tubez—Taking surfing to the streets."

BACKGROUND OF THE INVENTION (1) Field of Invention

The present invention relates to creating recreational and theatrical visual effects and, more particularly, to creating visual simulations of waves.

(2) Description of Related Art

The addition of visual effects to an activity is frequently used to heighten the experience or increase the enjoyment of a particular activity. Examples of visual effect generation systems are plentiful and include such things as green screens, computer generated imagery, movable sets on a theater stage, head mounted displays and toys designed to appear similar to their real counterparts (toy guns, e.g.). The central goal of most visual effect generation systems is to replicate a "real" thing, place or event in a way that helps the participant or observer better imagine the thing, place or event is real.

With respect to the creation of simulated waves for recreational purposes, the typical solution involves laying a standard rectangular tarp on the ground and having an individual hold one corner while running to the opposing corner, while a second individual rides through the "tube" that is created on a skateboard.

With all visual effect generation systems the primary concerns are safety, and cost. The typical solution of a standard rectangular tarp creates safety issues because its use requires the second individual to ride on top of the tarp while the tarp is being effectively pulled out from underneath that individual. Cost is negatively impacted because the material most tarps are made out of is poorly suited to being rolled over and stepped on repeatedly which leads to poor durability with associated replacement costs.

The present invention improves upon the typical solution by removing the need for the second individual to ride on top of the tarp. This increases the safety of the activity allowing the second individual to roll on a solid surface and prolongs the lifespan of the apparatus because wear and tear of created by the second individual is directed at the surface instead of on the apparatus.

Thus, given the general concerns for all visual effect generation systems of safety, cost, and realism, a continuing need exists for visual background simulations that are safer and more cost effective.

SUMMARY OF INVENTION

The present invention relates to an apparatus for creating a visual background simulation comprising a sheet having at least three edges, edge A, edge B, and a stationary edge. The sheet is proximate to a surface, which is substantially planar. A tow portion is attached to the sheet opposite the stationary edge such that when a force is applied to the tow portion areas of the sheet will move, but the stationary edge will not move relative to the surface.

In another aspect of the invention, a ballast is affixed to the stationary edge of the sheet of sufficient weight to ensure the stationary edge remains stationary relative to the surface when the force is applied.

Additionally, the ballast is comprised of multiple weights arrayed along the stationary edge.

In another aspect of the invention, the ballast is affixed to the stationary edge by enclosing the ballast within the sheet.

Additionally, the stationary edge is reinforced with multiple layers of material.

In yet another aspect of the invention, multiple reinforced anchor points are arrayed along the stationary edge to which the weights are attached.

In another aspect of the invention, the stationary edge is affixed to the surface using stakes.

In yet another aspect of the invention, a cord is attached to the tow portion.

Furthermore, the tow portion is reinforced with additional material.

Finally, as can be appreciated by one skilled in the art, the present invention also comprises a method for forming the visual background simulation described herein. The method comprises forming a sheet having at least three edges: edge A, edge B, and a stationary edge; affixing a tow portion to the sheet opposite the stationary edge; arranging the sheet such that it is substantially planar; affixing the stationary edge of the sheet to a surface which is substantially planar, such that the plane of the sheet and the plane of snake are substantially co-planar; and attaching the tow portion to a player at a point on the player that is not substantially co-planar with the surface.

Additionally, the method involves applying a force to the tow portion by having the player move in a direction which is co-planar to the surface and perpendicular to the stationary edge at a sufficient speed such the distance between the stationary edge and the tow portion is decreasing and air is caught between the stationary edge and the row portion.

Furthermore, the method involves applying a force to the tow portion to move the tow portion proximate to the surface after the player has continued to move perpendicular to the stationary edge and co-planar to the surface such that distance between the tow portion and the stationary edge is increasing instead of decreasing, thereby capturing air between the tow portion, the surface and the stationary edge.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
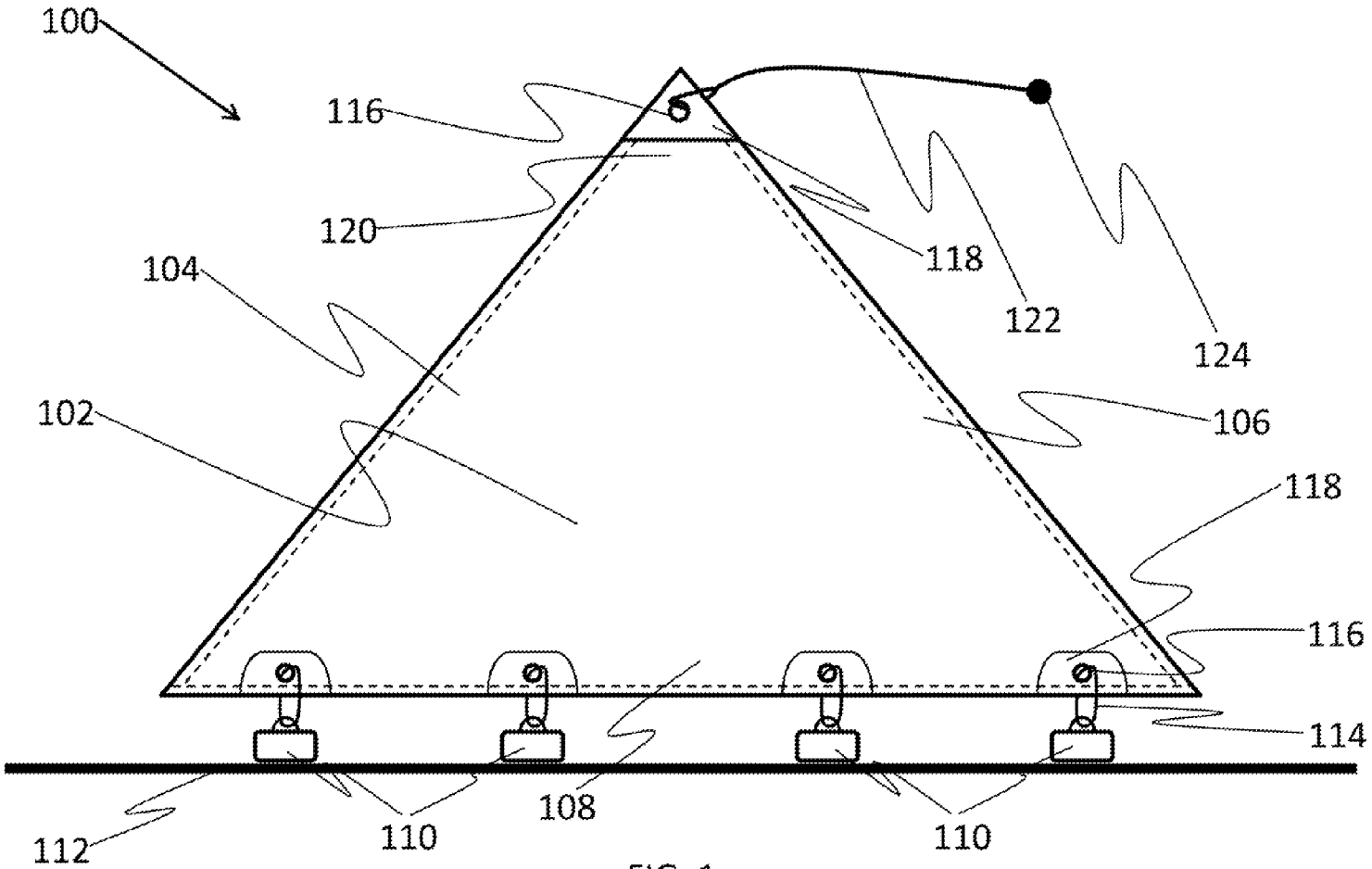
FIG. 1 is a front-view illustration of a visual background simulation according to the present invention.

The present invention relates to creating recreational and theatrical visual effects and, more particularly, to creating visual simulations of waves, The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will he apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to give the reader a general understanding of the present invention. Next, a description of various aspects of the present invention is provided to give an understanding of the specific details.

(1) Introduction

The present invention relates to creating recreational and theatrical. visual effects and, more particularly, to creating visual simulations of waves. A large sheet, roughly triangular in shape is laid out flat on a surface and attached to the surface on one side. A player takes hold of the portion of the sheet opposite the side attached to the surface and lifting their arm high in the air runs towards and eventually past the attached side. This allows the sheet to billow and catch the air. Once past the attached side, the player lowers their arm and traps the air in a "tube" formed by the sheet and the surface.

(2) The Interactive Package

As shown in FIG. 1, the present invention is a visual background simulation 100 for creating a visual simulation of waves. The visual background simulation 100 includes a sheet 102 having at least three edges, edge A 104, edge B 106, and a stationary edge 108. The sheet 102 can be made of any suitably flexible and durable material, non-limiting examples of which include plastic, rip-stop nylon, and fabric.

Attached to the stationary edge 108 are a series of ballasts 110. These ballasts 110 serve to fix the stationary edge 108 to the surface 112. The visual background simulation 100 is affixed to a surface 112 by any suitable means, non-limiting examples include weights of sufficient mass to anchor the sheet 102 to the surface 112, stakes, and adhesive tape. The mass of the ballasts 110 can be provided by any suitably dense material, non-limiting examples of which include water, metal, sand, dirt, and cement.

The ballasts 110 in the visual background simulation 100 are attached to the sheet 102 via, an attachment mechanism 114; non-limiting examples include carbineers, fasteners, Velcro, rope, or adhesives. In situations where the attachment mechanism 114 requires a hole in the sheet 102, such as a rope, or carbineer, a grommet 116 may be used to prevent tearing or premature wear of the sheet 102. In addition to a grommet 116, additional layers of material 118 may be added to the sheet 102, to the areas proximate to the grommet 116 to reinforce the sheet 102 and prevent tearing and premature wear.

In a non-limiting alternative arrangement, the ballasts 110 are attached to the sheet 102 by enclosing the ballasts 110 in the sheet 102 by means of placing the ballasts on the sheet 102 proximate to the stationary edge 108 and folding the stationary edge 108 over the ballasts 110 until stationary edge 108 can be fastened to the itself, essentially encasing the ballasts 110 within the stationary edge 108. Additional material 118 may be attached to the stationary edge 108 proximate to the ballasts 110 to further reinforce the stationary edge 108 which encloses the ballasts 110.

A tow portion 120 is located on the sheet 102 opposite the stationary edge 108. A cord 122 may be attached to the tow portion 120 to assist the player in pulling the tow portion 120. To further assist the player in grasping the cord 122, a ball 124 may be attached to the portion of the cord 122 which is opposite the portion of the cord 122 attached to the tow portion 120. The cord 122 may be made from any suitably flexible and durable material, non-limiting examples of which include polyethylene rope, manila rope and bungee cord.

Further, the tow portion 120 may be reinforced to reduce tearing and increase durability by incorporating a grommet 116 and additional layers of material 118.

Figure 2:
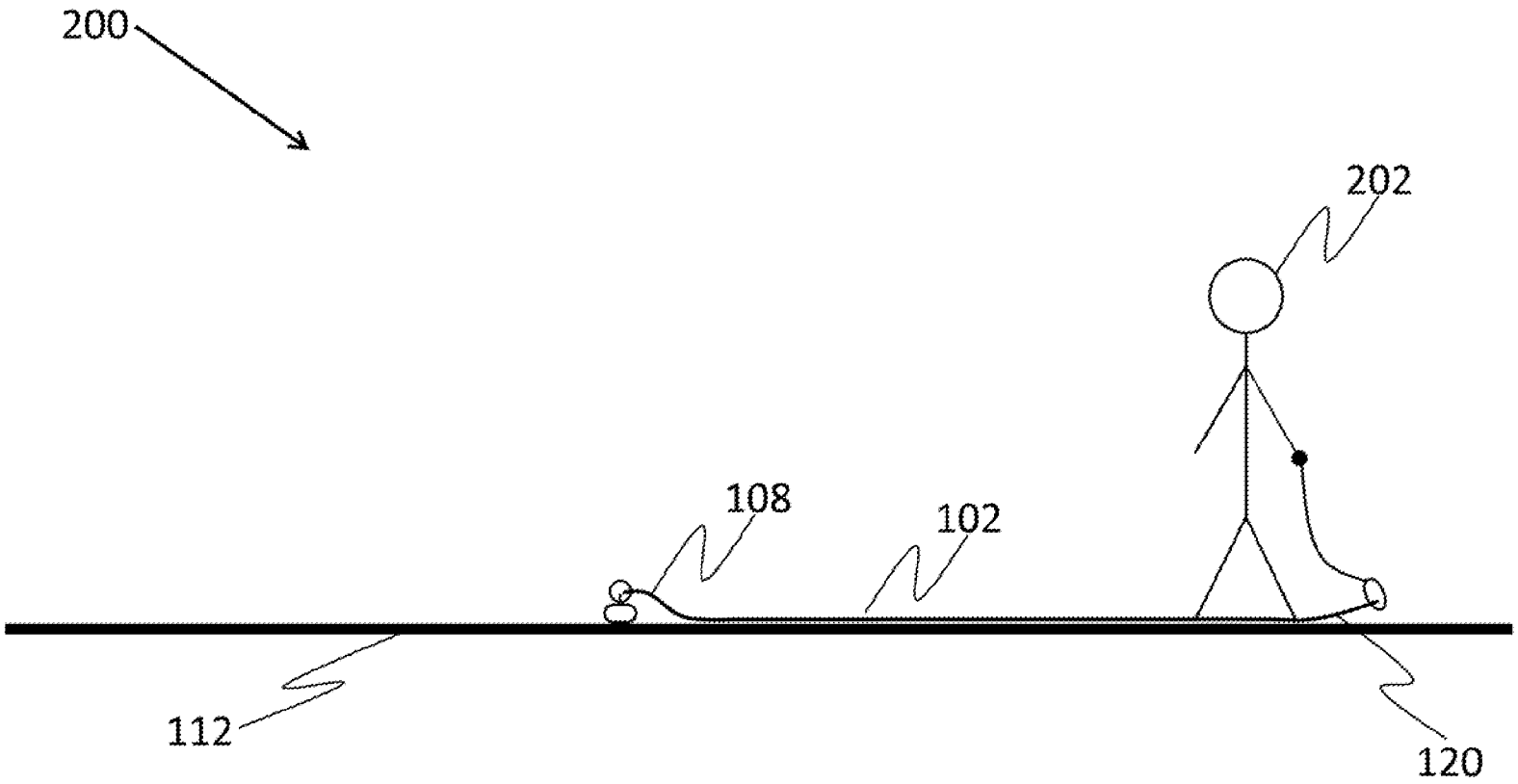
FIG. 2 is a left, side-view illustration of a method of using the visual background simulation according, to the present invention.
Figure 3:
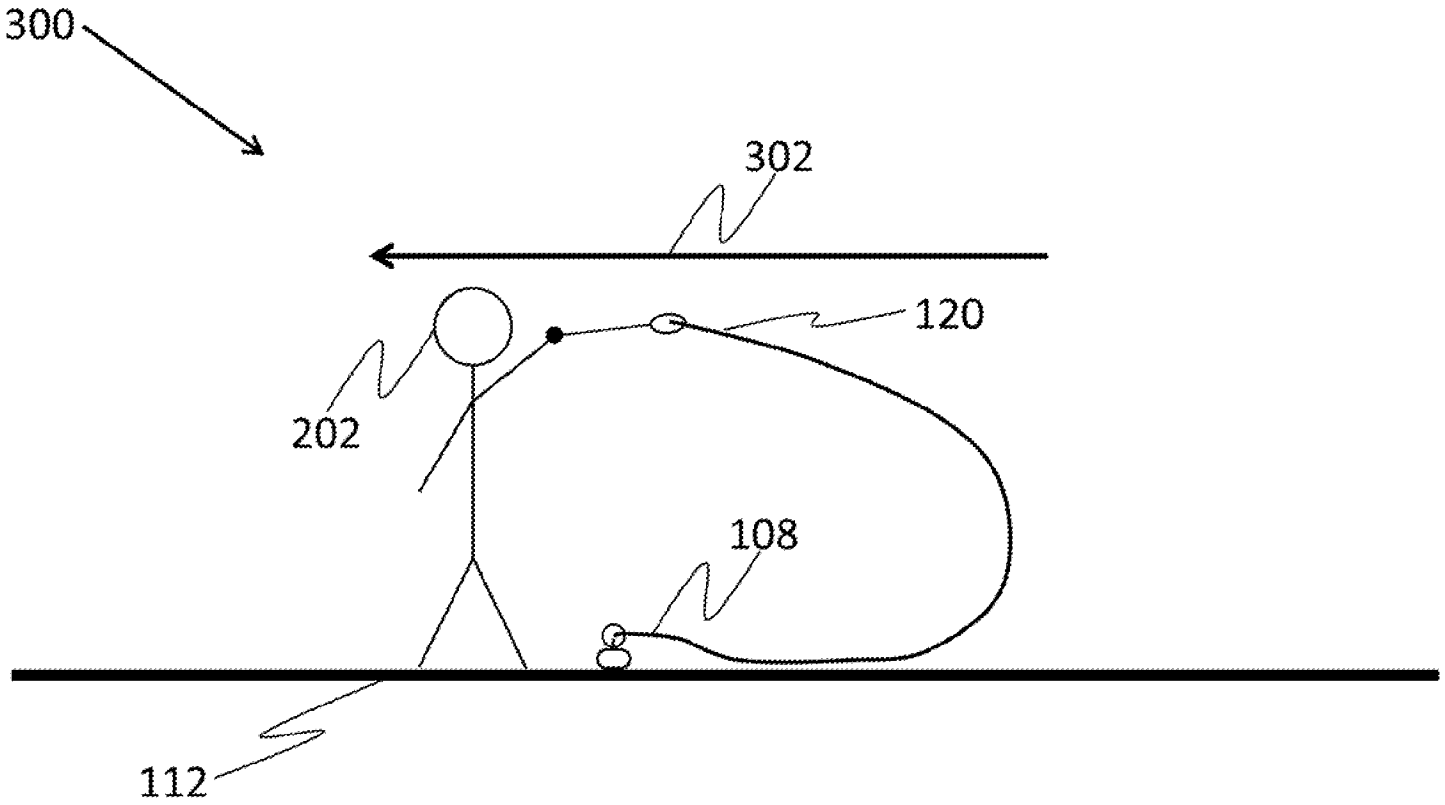
FIG. 3 is a left, side-view illustration of a method of using the visual background simulation according to the present invention.
Figure 4:
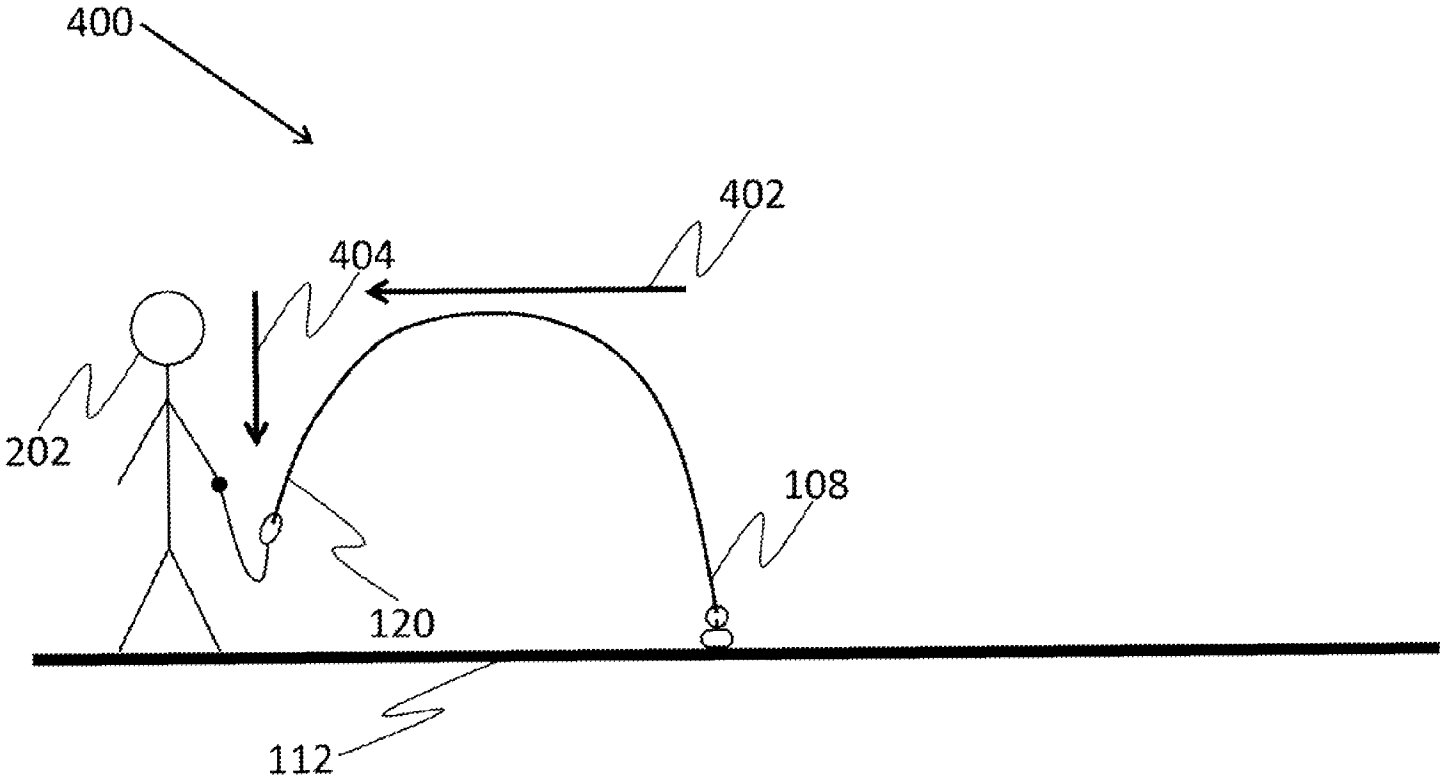
FIG. 4 is a left, side-view illustration of a method of using the visual background simulation according to the present invention.

FIGS. 2, 3, and 4 collectively illustrate a method of forming a visual background simulation according to the present invention. FIG. 2 shows the first set of acts 200 necessary for forming a background simulation according to the present invention. The method comprises acts of forming a sheet 102 having at least three edges: edge A, edge B, and a stationary edge 108; affixing a tow portion 120 to the sheet 102 opposite the stationary edge 108; arranging the sheet 102 such that it is substantially planar; affixing the stationary edge 108 of the sheet 102 to a substantially planar surface 112, such that the plane of the sheet 102 and the plane of surface 112 are substantially co-planar; and attaching the tow portion to a player 202 at a point on the player 202 that is not substantially co-planar with the surface 102.

Continuing from FIG. 2, FIG. 3 illustrates the second set of acts 300 necessary to form a visual background simulation according to the present invention which includes, applying a force to the tow portion 120 by having the player 202 move in a direction 302 which is co-planar to the surface 112 and perpendicular to the stationary edge 108 at a sufficient speed such the distance between the stationary edge 108 and the tow portion 120 is decreasing and air is caught between the stationary edge 108 and the tow portion 120.

Continuing from FIG. 3, FIG. 4 illustrates the third set of acts 400 necessary to form a visual background simulation according to the present invention which includes, applying a force 404 to the tow portion 120 to move the tow portion 120 proximate to the surface 112 after the player 202 has continued to move perpendicular 402 to the stationary edge 108 and co-planar to the surface 112 such that distance between the tow portion 120 and the stationary edge 108 is increasing instead of decreasing, thereby capturing air between the tow portion 120, the surface 112 and the stationary edge 108.

Figure 5:
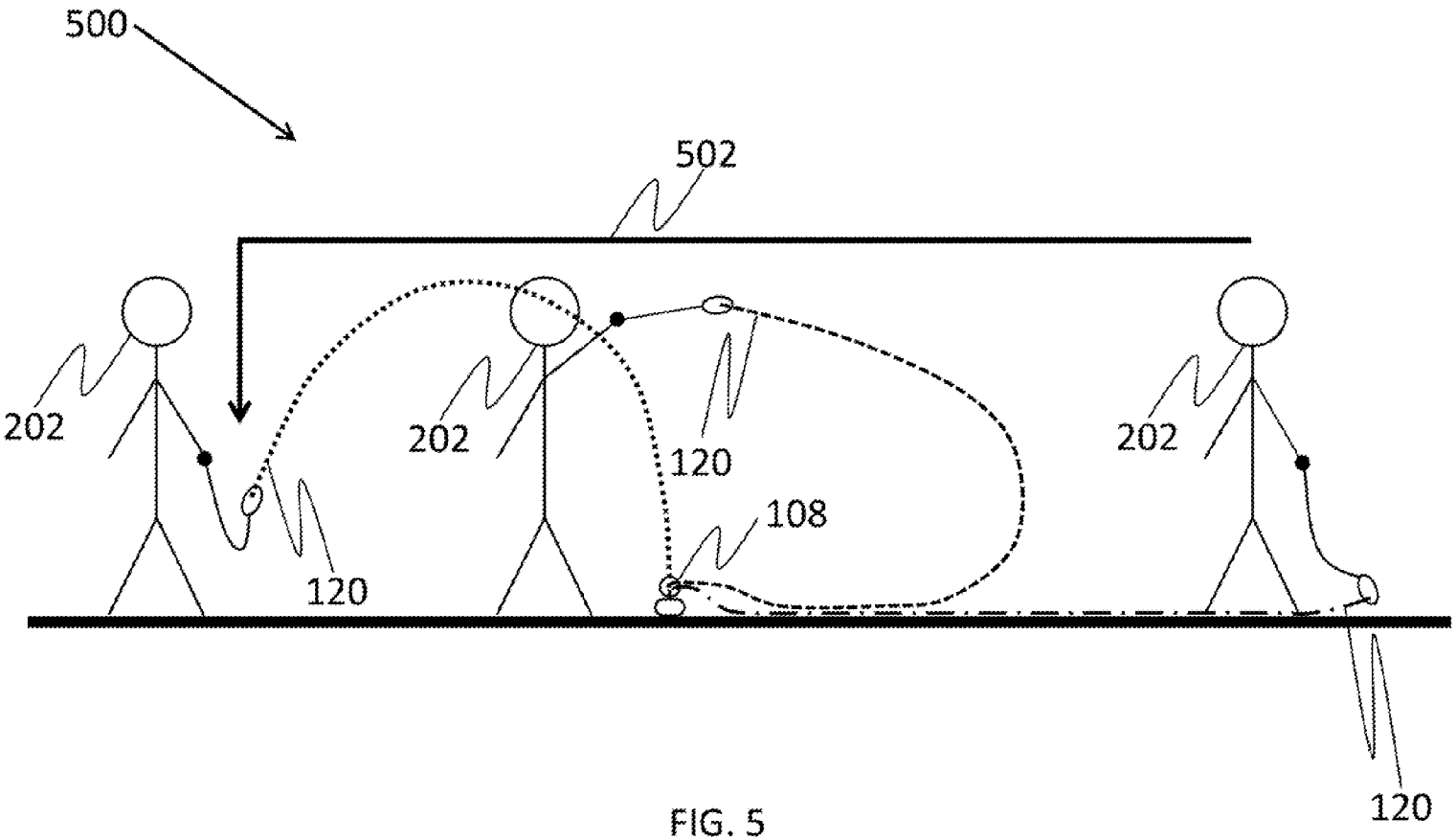
FIG. 5 is a left, side-view illustration of a method of using the visual background simulation according to the present invention.

FIG. 5 is a composite of FIGS. 2, 3, and 4. FIG. 5 illustrates the series of acts 500 necessary to form a visual background simulation according to the present invention. More particularly, it illustrates how the forces 502 the player 202 applies to the tow portion 120 causes the tow portion 120 to rotate about the axis of the stationary edge 108.

In addition to the description herein, one skilled in the art will appreciate that many alternative configurations for the described invention exist. One alternative configuration includes forming the sheet in a way that allows a player to slide upon a portion of the sheet while the remaining portions of the sheet forms a tube above the player. Another alternative configuration incorporates in the invention a liquid dispensing system for dispensing liquid in the area immediately around the invention. The liquid dispensing system may incorporate any suitable device for dispensing the liquid, non-limiting examples include sprayers, misters, spigots, and nozzles. An additional alternative configuration incorporates a blower to force air between the surface 112, the stationary edge 108 and the tow portion 120. The blower may incorporate any suitable means of forcing air through the apparatus, non-limiting examples include fans, air compressors, blowers and turbines.

What is claimed is:

1. An apparatus for creating a visual background simulation comprising:

a sheet having at least three edges, edge A, edge B, and a stationary edge;

a surface, which is substantially planar, proximate to the stationary edge:

a tow portion, attached to the sheet and opposite the stationary edge, such that when a force is applied to the tow portion, areas of the sheet will move, but the stationary edge will not move relative to the surface thereby creating a tube comprised of the surface and the sheet.

2. An apparatus as set forth in claim 1, wherein a ballast is affixed to the stationary edge of the sheet of sufficient weight to ensure the stationary edge remains stationary relative to the surface when the force is applied.

3. An apparatus as set forth in claim 2, wherein the ballast is comprised of multiple weights arrayed along the stationary edge.

4. An apparatus as set forth in claim 3, wherein multiple reinforced anchor points are arrayed along the stationary edge to which the weights are attached.

5. An apparatus as set forth in claim 2, wherein the ballast is affixed to the stationary edge by enclosing the ballast within the sheet.

6. An apparatus as set forth in claim 5, wherein the stationary edge is reinforced with multiple layers of material.

7. An apparatus as set forth in claim 1, wherein the stationary edge is affixed to the surface.

8. An apparatus as set forth in claim 1, wherein the stationary edge is affixed to the surface using stakes.

9. An apparatus as set forth in Claim I, wherein a cord is attached to the tow portion.

10. An apparatus as set forth in claim 1, wherein the tow portion is reinforced with additional material.

11. An apparatus as set forth in claim 1, wherein the invention further incorporates a dispenser to dispense liquid in the area immediately around the sheet.

12. An apparatus as set forth in claim 1, wherein the invention further incorporates a blower for forcing air between the tow portion, the stationary edge, and the surface.

13. A method for forming a visual background simulation comprising:

forming a sheet having at least three edges: edge A, edge B, and a stationary edge;

affixing a tow portion to the sheet opposite the stationary edge;

arranging the sheet such that it is substantially planar;

affixing the stationary edge of the sheet to a substantially planar surface, such that the plane of the sheet and the plane of surface are substantially co-planar; and attaching the tow portion to a player at a point on the player that is not substantially co-planar with the surface.

14. A method for creating a visual background simulation comprising:

applying a force to a tow portion by having, a player move in a direction which is co-planar to a surface and perpendicular to a stationary edge at a sufficient speed such the distance between the stationary edge and the tow portion is decreasing and air is caught between the stationary edge and the tow portion; and applying a force to the tow portion to move the tow portion proximate to the surface after the player has continued to move perpendicular to the stationary edge and co-planar to the surface such that distance between the tow portion and the stationary edge is increasing instead of decreasing, thereby capturing air between the tow portion, the surface and the stationary edge.

15. A method as set forth in claim 14 including the act of utilizing a blower to force air between the surface, tow portion and stationary edge.

* * * * *